US005383086A

United States Patent [19]

Wietelmann et al.

[11] Patent Number: 5,383,086

[45] Date of Patent: Jan. 17, 1995

[54] SYSTEM AND METHOD FOR TRIGGERING AN INDUCTIVE CONSUMER

[75] Inventors: Juergen Wietelmann, Ditzingen; Thomas Rueping, Lenningen; Norbert Mueller, Tamm; Wolfgang Duehlmeyer, Schwieberdingen, all of Germany

[73] Assignee: Robert Bosch GmbH, Stuttgart, Germany

[21] Appl. No.: 984,161

[22] Filed: Dec. 2, 1992

[30] Foreign Application Priority Data

Dec. 5, 1991 [DE] Germany ..... 4140043

[51] Int. Cl.[6] ..... H01H 47/32

[52] U.S. Cl. ..... 361/152; 307/125; 361/187

[58] Field of Search ..... 361/139, 143, 152, 160, 361/170, 187; 307/116, 125, 131

[56] References Cited

U.S. PATENT DOCUMENTS

| | | | |
|---|---|---|---|
| 4,393,888 | 10/1981 | McCarty | 361/152 |
| 4,589,401 | 5/1986 | Karim et al. | 361/152 |
| 4,825,332 | 4/1989 | Aoki | 361/152 |
| 5,038,247 | 8/1991 | Kelley et al. | 361/152 |
| 5,222,011 | 6/1993 | Braun | 361/152 |

*Primary Examiner*—Jeffrey A. Gaffin

*Attorney, Agent, or Firm*—Kenyon & Kenyon

[57] ABSTRACT

In a system for triggering an inductive consumer, particularly a consumer for controlling an internal combustion engine, the consumer is coupled via a circuit element to a voltage source. A control means triggers the circuit element in the switching mode for a preselected ON duration. Furthermore, means are provided for measuring the current flowing through the inductive consumer. To measure an actual current value, a first current value is measured shortly after the closing operation, and a second current value is measured immediately before the opening operation.

14 Claims, 2 Drawing Sheets

SYSTEM AND METHOD FOR TRIGGERING AN INDUCTIVE CONSUMER

FIELD OF THE INVENTION

The present invention relates to a system and method for triggering an inductive consumer and in particular to a system and method for triggering an inductive consumer which is used to control the power output of a motor vehicle.

BACKGROUND OF THE INVENTION

A system for triggering an inductive consumer is described in German Published Patent Application No. 28 05 876. The system is used to influence the power output of motor vehicles. As such, inductive consumers are used, particularly in diesel gasoline engines, to position the control rod or corresponding components. However, inductive consumers may also be used to position the throttle valve of externally-ignited internal combustion engines.

In these types of systems, an inductive consumer is connected to a voltage source via a circuit element. A controller triggers the circuit element in the switching mode for a preselected ON duration.

To precisely control the power output of the internal combustion engine, the throttle valve or the control rod, must be set very precisely to a preselected position. To achieve this, the actual current flowing through the consumer must be measured very accurately.

An object of the present invention is to provide a system for triggering an inductive consumer which enables a precise and simple measurement of the current flowing through the consumer.

SUMMARY OF THE INVENTION

The present invention is directed to a system and method for triggering an inductive consumer in which a first current flow through the inductive consumer is determined shortly after a closing operation of a switching circuit element coupled to the inductive consumer. A second current flow through the inductive consumer is determined immediately before an opening operation of the switching circuit element. An actual current flow through the inductive consumer is then determined based upon the first and second current flows. As such, the system and method according to the present invention provide for the simple and precise measurement of the actual current that flows through the inductive consumer.

DETAILED DESCRIPTION OF THE INVENTION

The system according to the present invention will be described based on the example of a device for positioning an actuator for injecting fuel into a diesel gasoline engine. Such actuators are used, for example, to adjust the fuel quantity to be injected, i.e., the moment at which injection begins. When modified appropriately, the system according to the present invention can also be used for positioning a throttle valve of an externally-ignited internal combustion engine.

Figure 1:
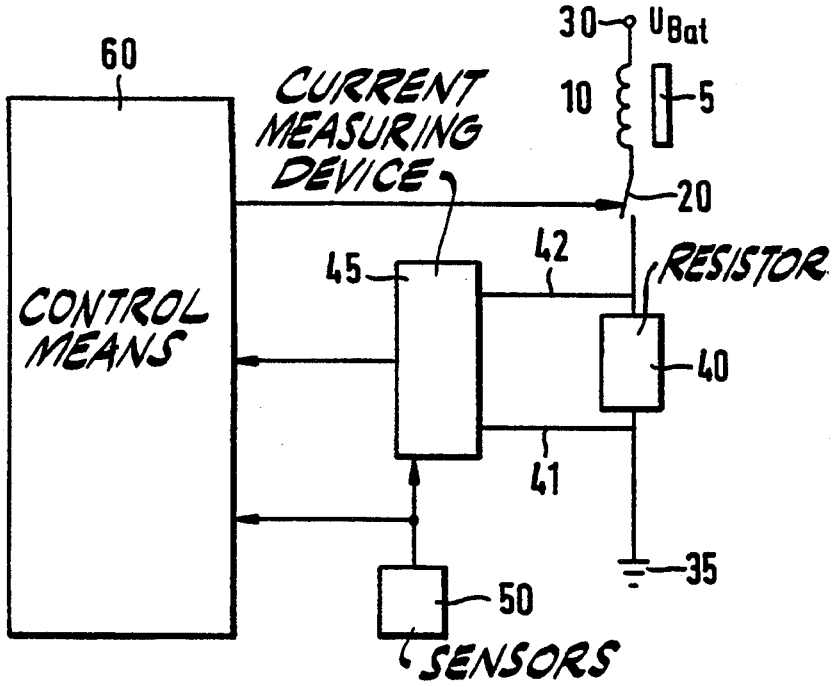
FIG. 1 shows a block diagram of the system according to the present invention.

The important elements of the system according to the present invention are shown in FIG. 1. An inductive consumer 10, also referred to as a coil, is coupled, on one side, via a circuit element 20, as well as a measuring means 40, to ground 35 and, on the other side, to the positive pole 30 of a supply voltage. The inductive consumer 10 is used to shift a movable actuator 5.

The measuring means 40 is coupled via lines 41 and 42 to a measuring device 45. The means for measuring current 45 and 40 transmit a signal to a control means 60, which in turn transmits a trigger signal to the circuit element 20. Various sensors 50 are coupled to both the control means 60 and the measuring device 45.

The terminal connections 30 and 35, with which the coil is coupled to the positive pole of the supply voltage and to ground, respectively, can instead be arranged in the opposite manner. Typically, the battery provides the supply voltage, in which case, the supply voltage corresponds to the battery voltage. It is also possible, however, to use a stabilized supply voltage.

The system according to the present invention functions as follows. The control means 60 triggers the circuit element 20 in the switching mode for a preselected ON duration D. In accordance with this triggering, the circuit element 20 couples the coil to ground. This results in a proper flow of current through the series connection of the coil 10, the circuit element 20, and the measuring means 40.

Dependent upon the current flowing through the coil, the actuator 5 assumes a certain position. If the actuator is the control rod of a diesel gasoline engine, the fuel quantity to be injected can be influenced by the current flowing through the coil. If the particular actuator is the actuator for the beginning of injection of a diesel gasoline engine, the instant at which injection begins can be influenced by the current flowing through the coil. The position of the actuator therefore depends upon the actual value of the current flowing through the coil 10.

Preferably, semiconductor components are used as circuit elements. It is also possible, however, to use mechanical switching devices, such as relays. The measuring means 40 is preferably an ohmic resistor. Because of the current flowing through the resistor, a voltage drop, which is proportional to the current, forms across this ohmic resistor. The voltage drop is measured by the measuring device 45 through the two lines 41 and 42.

Based upon this voltage drop across the resistor 40, the measuring device 45 calculates the actual current flowing through the resistor 40, and, thus, also through the coil 10. To calculate the actual current flowing through the coil, the variables pertaining to the operating state of the internal combustion engine measured by the sensors 50 are evaluated by the current measuring device 45.

It is an advantageous feature of the present invention that a temperature variable, or the level of the supply voltage, is measured by the sensor 50. Preferably, no further sensors are used to measure these signals. Instead, the system retrieves the signals required by the control means to determine the fuel injection quantity, for example.

In the control means, the calculated current value for the actual current is compared to a preselected threshold value. Dependent upon the comparison, the control means then varies the ON duration D, i.e., the pulse duty factor for triggering the circuit element 20. To select the threshold value, the control means 60 evaluates the signals supplied by the sensors 50.

Figure 2:
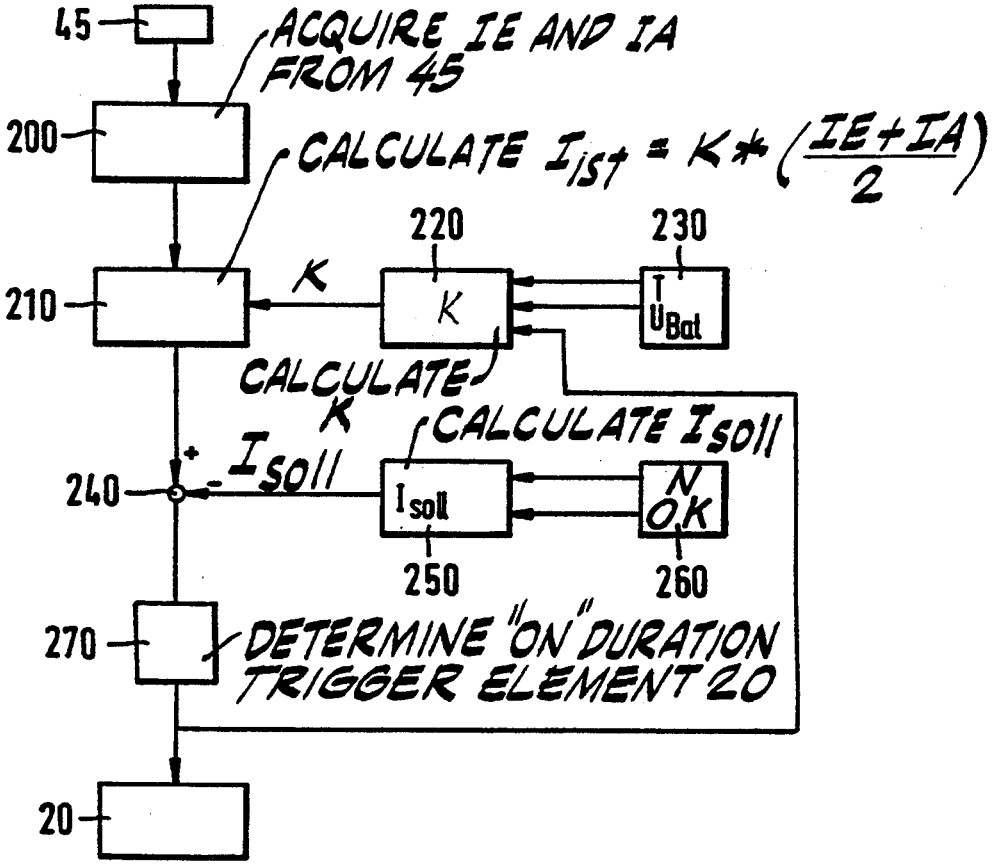
FIG. 2 illustrates the method for determining the actual current flow through an inductive consumer according to the present invention.

FIG. 2 illustrates in greater detail the method of calculating the actual current value and of generating the trigger signal according to the present invention. In a first unit 200, the measuring device 45 measures two current values. In accordance with the principles of the present invention, a first current value IE is measured shortly after the closing operation, and a second current value IA is measured immediately before the opening operation.

During the closing operation, the switch 20 is brought into the position in which current flows through the coil 10. During the opening operation, the circuit element is brought into the position in which no current flow is possible. The first current value IE is preferably measured approximately 80 microseconds after the closing operation. The second current value IA is measured immediately before the switch is triggered.

The actual, effective current value is then calculated in unit 210. For this purpose, the average value is first generated from the first current value IE and the second current value IA. This value is subsequently multiplied by a correction factor K. The correction factor depends essentially on the coil temperature, the ON duration D, and the voltage applied to the coil. By using the coolant temperature of the internal combustion engine instead of the coil temperature, a temperature sensor to measure the coil temperature is no longer necessary.

The coolant temperature and the battery voltage are therefore measured in unit 230. In unit 220, the device reads the correction factor K from one or two engine characteristics maps dependent upon the coolant temperature, the battery voltage, and the ON duration D. For this purpose, the signal relating to trigger duration is transmitted as an output signal of unit 270 to unit 220.

The actual current value $I_{ist}$ is calculated according to the expression:

$$I_{ist}=K^*(IA+IE)/2 \quad (1)$$

The reference point 240 compares the calculated current value $I_{ist}$ to the threshold value $I_{soll}$ for the coil current, which is selected by unit 250. The control means 60 selects the threshold current value $I_{soll}$, preferably dependent upon at least the rotational speed N and the desired fuel quantity OK, or instead dependent upon the desired position of the control rod 5. Numerous variables, which are not all listed here, affect the desired fuel quantity. For this purpose, the rotational speed and the desired fuel quantity are measured in unit 260. The threshold current value $I_{soll}$ is then calculated in one or more engine characteristics maps in unit 250.

In the case of gasoline engines, it is not the desired position of the control rod that is determined, but rather the desired position of the throttle valve.

An advantageous modification of the present invention provides for a position controller, which compares the position of the control rod to a preselected value and selects a threshold current value dependent upon this comparison. This position controller then takes the place of units 250 and 260.

The comparative result of the reference unit 240 is then fed to a controlling unit 270. The controlling unit 270 determines the new ON duration D dependent upon the comparative result. The circuit element 20 is then triggered using this ON duration D. If the actual value is less than the threshold value, the ON duration D is prolonged accordingly. If the actual value is greater than the threshold value, the 0N duration D is shortened accordingly.

Figure 3:
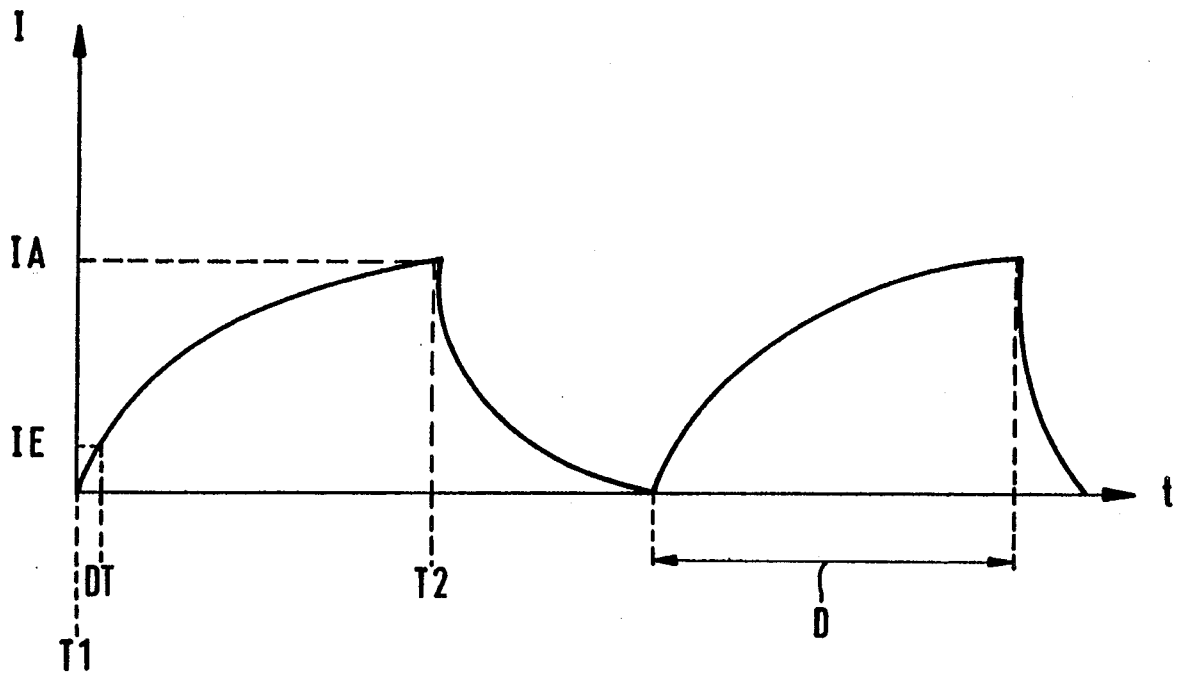
FIG. 3 is a graph of a characteristic curve of the current flowing through the inductive consumer as a function of time.

The characteristic curve of the current I flowing through the coil is plotted over time t in FIG. 3. The switch 20 is closed at instant T1, i.e., the current is brought into the circuit. The result is that the current rises in accordance with a specified function, particularly in accordance with an exponential function. The switch is again opened at instant T2, and the current flow is interrupted. The result is that the current flowing through the coil drops in accordance with a specified function, particularly in accordance with an exponential function.

The first current value IE is measured one time interval DT after instant T1. The second current value IA is measured immediately before the signal for disconnecting or interrupting the current is output. The instants T1 and T2, as well as the corresponding current values IE and IA, are shown in FIG. 3.

Because of the special configuration of the measuring resistor 40, the drop in current after the current is discontinued cannot be measured. Nevertheless, the actual current value can be determined quite easily with the system according to the present invention.

The terms and expressions which are employed herein are used as terms of expression and not of limitation. And, there is no intention, in the use of such terms and expressions, of excluding the equivalents of the features shown, and described, or portions thereof, it being recognized that various modifications are possible within the scope of the invention.

What is claimed is:

1. A system for triggering an inductive consumer and for determining an effective current flowing through the inductive consumer, comprising:

a switching circuit element, the switching circuit element coupling the inductive consumer to a voltage source;

means for selectively triggering the switching circuit element to switch the switching circuit element between a closing operation and an opening operation;

means for determining a first current flow through the inductive consumer a predetermined time period after the closing operation, for determining a second current flow through the inductive consumer a predetermined time period before the opening operation, and for determining an effective current flow through the inductive consumer based upon the first and second current flows.

2. The system according to claim 1, wherein the means for determining the actual current flow includes means for determining an average current flow of the first and second current flows.

3. The system according to claim 2, wherein the means for determining the actual current flow further includes means for correcting the determined average current flow based upon at least one of a preselected 0N duration, a supply voltage level, and a coolant temperature.

4. The system according to claim 3, wherein the correcting means further includes means for multiplying the determined average current flow by a correction factor.

5. The system according to claim 1, further comprising means for comparing the determined actual current flow to a preselected threshold value.

6. The system according to claim 5, wherein the switching circuit element is triggered as a function of the comparison between the determined actual current flow and the preselected threshold value.

7. The system according to claim 1, wherein the first current flow is determined approximately 80 microseconds after the closing operation.

8. A method of triggering an inductive consumer and for determining an effective current flowing through the inductive consumer, comprising the steps of:

selectively triggering a switching circuit element coupled to the inductive consumer to switch the switching circuit element between a closing operation and an opening operation;

determining a first current flow through the inductive consumer a predetermined time period after the closing operation;

determining a second current flow through the inductive consumer a predetermined time period before the opening operation; and determining an effective current flow through the inductive consumer based upon the determined first and second current flows.

9. The method according to claim 8, wherein the step of determining the actual current flow includes the step of determining an average current flow of the first and second current flows.

10. The method according to claim 9, wherein the step of determining the actual current flow further includes the step of correcting the determined average current flow based upon at least one of a preselected 0N duration, a supply voltage level, and a coolant temperature.

11. The method according to claim 10, wherein the correcting step includes the step of multiplying the determined average current flow by a correction factor.

12. The method according to claim 8, further comprising the step of comparing the determined actual current flow to a preselected threshold value.

13. The method according to claim 12, wherein the triggering of the switching circuit element is performed as a function of the comparison between the determined actual current flow and the preselected threshold value.

14. The method according to claim 8, wherein the first current flow is determined approximately 80 microseconds after the closing operation.

* * * * *